US005559586A

United States Patent [19]

Wada

[11] Patent Number: 5,559,586

[45] Date of Patent: Sep. 24, 1996

[54] IMAGE FORMING DEVICE HAVING CONTROL GRID WITH APPLIED VOLTAGE OF THE SAME POLARITY AS TONER

[75] Inventor: Takasumi Wada, Nara, Japan

[73] Assignee: Sharp Kabushiki Kaisha, Osaka, Japan

[21] Appl. No.: 561,142

[22] Filed: Nov. 21, 1995

Related U.S. Application Data

[63] Continuation of Ser. No. 291,337, Aug. 17, 1994, abandoned, which is a continuation of Ser. No. 1,116, Jan. 6, 1993, abandoned.

[30] Foreign Application Priority Data

Jan. 7, 1992 [JP] Japan ..... 4-000588

[51] Int. Cl.[6] ..... G03G 15/06

[52] U.S. Cl. ..... 355/245; 355/251; 347/55

[58] Field of Search ..... 355/245, 251, 355/253; 118/656–658; 346/153.1, 154, 155; 347/55

[56] References Cited

U.S. PATENT DOCUMENTS

| | | | |
|---|---|---|---|
| 4,690,539 | 9/1987 | Radulski et al. | 355/272 |
| 4,780,733 | 10/1988 | Schmidlin . | |
| 5,036,341 | 7/1991 | Larsson | 346/154 |
| 5,078,087 | 1/1992 | Hogestyn | 355/251 X |
| 5,121,144 | 6/1992 | Larson et al. | 346/154 |
| 5,235,354 | 8/1993 | Larson | 346/154 |
| 5,374,949 | 12/1994 | Wada et al. | 355/245 X |

FOREIGN PATENT DOCUMENTS

| | | |
|---|---|---|
| 3-168766 | 7/1991 | Japan . |
| 3-168767 | 7/1991 | Japan . |
| 3-168768 | 7/1991 | Japan . |
| 3-168769 | 7/1991 | Japan . |
| 3-168770 | 7/1991 | Japan . |
| 89/05231 | 6/1989 | WIPO . |
| 90/14960 | 12/1990 | WIPO . |

*Primary Examiner*—Matthew S. Smith

*Attorney, Agent, or Firm*—Kevin J. Fournier; William J. Daley, Jr.

[57] ABSTRACT

In the invention, toner on a toner carrier is charged with negative polarity and attracted by applying positive voltage to a backing electrode placed at the back of a transfer belt. Voltage is applied across the electrodes arranged crosswise in directions X and Y of the control grid disposed between the transfer belt and the toner is changed so as to vary the toner repulsing force in space-charged opening XY of the control grid and thereby to regulate the amount of toner passing therethrough.

8 Claims, 16 Drawing Sheets

IMAGE FORMING DEVICE HAVING CONTROL GRID WITH APPLIED VOLTAGE OF THE SAME POLARITY AS TONER

This is a Continuation of Application No. 08/291,337, filed Aug. 17, 1994, now abandoned, which is a Continuation Application of application No. 08/001,116, now abandoned.

BACKGROUND OF THE INVENTION

The present invention relates to an image forming device which is capable of producing an image with toner directly onto a recording element (e.g., a transfer belt) by means of an electric signal (information carrier) and further of transferring and fixing the toner image onto a sheet of transfer paper.

One of the conventional methods for converting an electric signal into a visible image on a recording element (e.g., a sheet of transfer paper) is xerography whereby a latent image is produced by a light recording means and developed with developing powder (hereinafter referred to as "toner"). This method consists of steps for converting an electric signal of image information taken from an original source into a light signal by means of a laser or LED head; exposing to said light signal a photo-sensitive image carrier uniformly charged in advance with statistic electricity; producing a latent image on the photo-sensitive surface according to the light's intensity; letting the toner from the toner carrier make contact with or move on to the latent image to develop the image on the photo-sensitive surface; electrically transferring the toner image to the recording element and then fixing the toner image on the recording element by pressing and/or heating.

Besides the above-mentioned xerography, there is the conventional method of using the combination of an ion generator, a control grid and an image-carrying dielectric drum which conducts the steps of adjusting an ion current passing through the control grid by controlling said control grid according to an electric signal, forming an electrically charged image (latent image) on the dielectric drum in accordance with the electric signal, developing the latent image with toner, transferring the toner of the developed image to a recording element (a sheet of transfer paper) and then fixing the image thereon by pressing and/or heating in the same way as the xerography.

Since the above-mentioned method produces a latent image from the electric signal on the image carrier and develops the latent image with toner, it is necessary to use a writing means for forming the latent image on the image carrier and a means for erasing the used latent image from the image carrier so as to be able to use the latter repeatedly. There is left the problem that the image carrier which usually is made of a photo-sensitive material (e.g., selenium) has the characteristics necessary for forming thereon a latent image but is sensitive to heat and mechanical shocks and contains toxic substances.

Japanese laid open patent publication No. 44457-83 discloses an image-forming method which does not require the use of an image carrier and in which a control grid having two electrodes separated from each other by an insulating layer with openings passing through both electrodes and the insulating layer is placed between a toner carrier (developing tank) and a recording element and a backing electrode is placed on the back of the recording element opposite the side facing the control grid. The first electric field is produced between the toner carrier and the side facing the control electrode, the second electric field is produced between the toner carrier side opening of the control grid and the recording element side electrode and the third electric field is produced between the electrode facing the recording element and the recording element itself. When an electric field is formed within the control grid's opening to allow the toner to pass therethrough from the control electrode facing the toner carrier to the control electrode facing the recording element, the toner particles are transferred to the recording element. At least one of the control electrodes must work with voltage applied thereto for producing a toner attracting force and provided with a means for applying AC voltage for preventing the adhesion of toner particles thereto.

In the above-mentioned method, the adhesion of toner particles to the electrode can be prevented but the adhesion to the insulating wall surfaces within the openings cannot completely be avoided, Consequently, clogging of the grid openings with toner particles may occur making it impossible to form an accurate toner image and also causing the lowering of the printing quality. Frequent cleaning of the control electrodes or replacement of the parts is needed to keep the printing quality at the required level. Maintenace work is difficult and is expensive.

In view of the above-mentioned problems, the present applicant has proposed the provision of an image-forming device which does not require an image carrier such as photo-sensitive material and which also has control electrodes free from the adhesion of toner particles.

SUMMARY OF THE INVENTION

It is an object of the present invention to provide an image forming device capable of produecing an image with toner directly on a transferring medium by means of an electrical information signal, and further of tranferring and fixing the toner image onto a print-receiving paper.

It is another object of the present invention to provide an image forming device in which toner on a toner carrier is charged with negative prolarity and attracted by applying positive voltage to a backing electrode placed at the back of a transferring medium, voltage applied across the electodes arranged crosswise in directions X and Y of the control grid disposed between the transferring medium and the toner is charged so as to vary the toner repulsing force in space-charged openings XY of the control grid and thereby to regulate the amount of toner passing therethrough.

It is another object of the present invention to provide an image forming device in which a toner image can be formed on a transferring medium on the condition that the control grid always keeps the repulsing force to the toner. Consequently, the control grid is free of clogging its openigs with toner particles and does not reguire frequent cleaning and/or replacement of the parts.

PREFERRED EMBODIMENT OF THE INVENTION

Figure 1:
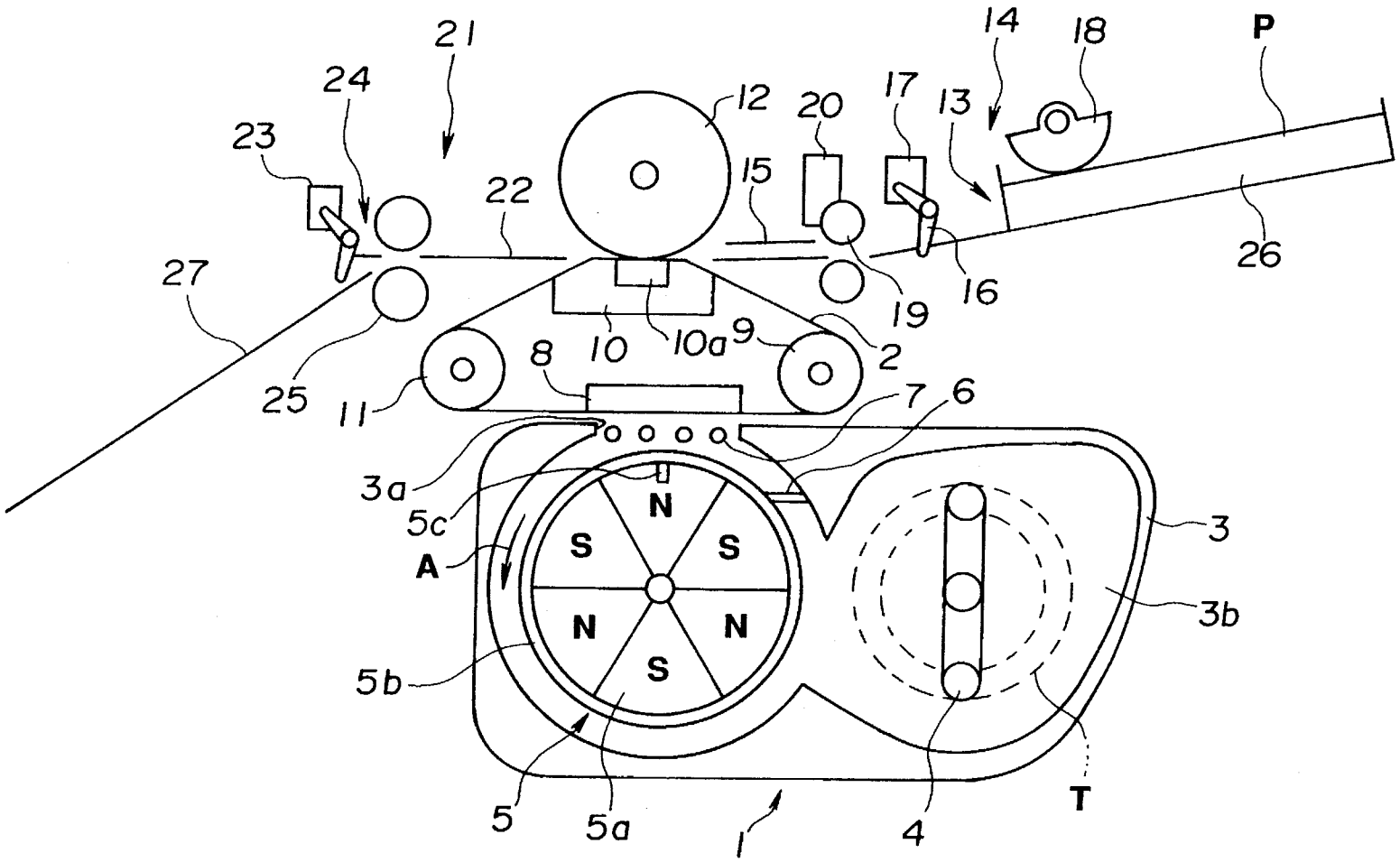
FIG. 1 is a view for explaining the construction of an image-forming device shown in FIG. 2.
Figure 2:
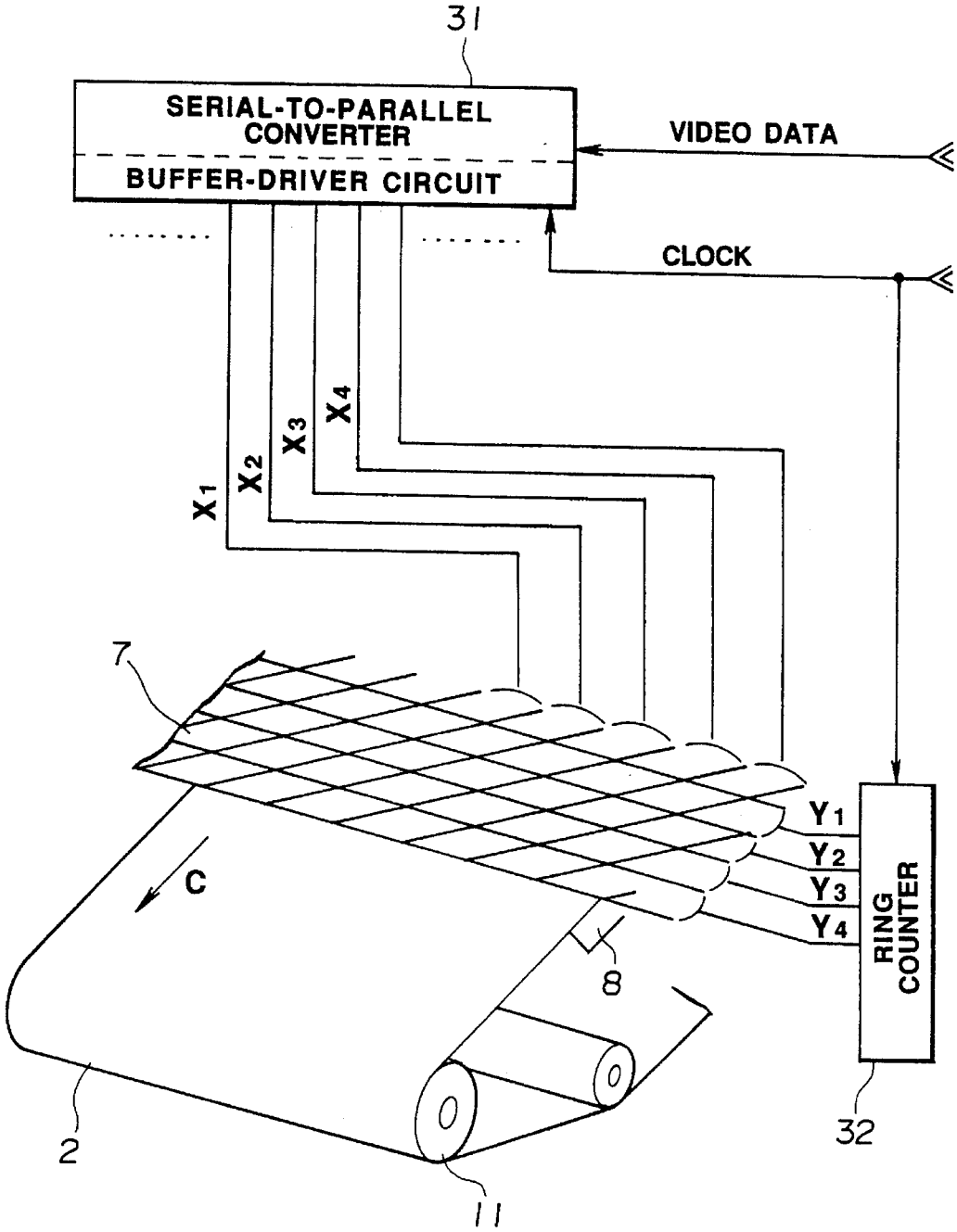
FIG. 2 is a control block-diagram of a control grid of an image forming device embodying the present invention.

Referring now to the accompanying FIGS. 1 to 16, a preferred embodiment of the present invention will be described in detail as follows:

As shown in FIG. 1, an image forming device according to the present invention has a developing unit 1 placed at its center.

The above-mentioned developing unit 1 comprises a toner hopper 3*b* for storing insulating magnetic toner T to be used as developer, a developing tank 3 surrounding the toner hopper 3*b*, a toner mixing roller 4 rotatably installed in the toner hopper, a toner carrier 5 placed underneath the opening 3*a* of the developing tank and a doctor blade attached to the right upper portion of the toner carrier 5.

The above-mentioned toner carrier 5 is made in the form of a cylinder elongating inwardly from the shown side, which includes a roller 5*a* having magnets arranged side by side with the opposite polarities N and S at its circumference and a toner transporting cylinder 5*b* grounded at one end and enclosing the outer cylindrical surface of the magnet roller 5*a*.

The toner carrier 5 holds toner T on the surface of the toner transporting cylinder 5*b* which rotates to transport the toner in the direction shown by arrow A. The doctor blade 6 adjusts the amount of the toner T to be fed as supported on the surface of the toner transporting cylinder.

The magnets in the magnet roller 5*a* of the toner carrier 5 are placed in such a way that a repulsing magnetic field may be produced at the position facing a backing electrode 8 to be described later, thereby the magnetic force constraining the toner T weakens in the space between the magnet roller and the backing electrode.

The above-mentioned toner is composed of 10 micron powder obtained by pulverizing a mixture of stylene-acrylic co-polymer resin with magnetite added thereto to the content of 50% by weight and has a negative polarity because of the toner transporting cylinder's 5*b* being grounded.

In an opening 3*a* of the developing tank, a control grid 7 composed of a plurality of groups of electrodes (conductors) is placed at its surface parallel to a transfer belt 2 (recording element) placed above the opening 3*a*. A toner image is formed on the transfer belt by adjusting the amount of toner T adhering thereto.

The transfer belt 2 is an endless band of e.g., 20 μm thick polyimide resin having high mechanical strength and high heat resistance. As shown in FIG. 1, this transfer belt 2 is placed over a driving roller 9 placed at the right side, a fixing holder 10 placed at the center upper position and a tension roller 11 provided with a mechanism for preventing the belt from moving zigzag and placed at the left side.

The fixing holder 10 for melting by heating the toner T transferred on the outer surface of the transfer belt 2 is made of an aluminum ceramic substrate having a heating element 10*a* of molybdenum (Mo) (resistance type heating element) printed thereon and a glass layer coated on the heating element 10*a*. When an electric current is passed through the heating element, this fixing holder 10 can quickly reach the required temperature of its heated surface by being in direct contact with the inner surface of the transfer belt 2.

A pressing roller 12 is placed on the transfer belt 2 above the fixing holder 10, which rotates with applied pressure to the heated surface of the fixing holder 10 through the transfer belt 2. A sheet of transfer paper P fed from a transfer paper feeder 14, which will be described later, is caught and pressed between the pressing roller and the transfer belt 2.

Between the driving roller 9 and the tension roller 11 is provided the backing electrode 8 being in close contact with the inner surface of the transfer belt 2. This rear side electrode 8 is supplied with voltage having a reverse polarity to that of the toner so as to attract the toner toward the transfer belt 2. In the present embodiment, the toner is negatively polarized and therefore the backing electrode 8 is supplied with positive voltage of 2000 v from a voltage applying unit (not shown) to produce the attracting force necessary for transferring the toner to the transfer belt 2.

A pressing portion where the transfer belt 2 and pressing roller 12 make contact with each other is provided with a transfer paper feeder 14 at the inlet side thereof and a paper delivery unit 21 at the outlet side thereof for the moving sheet of transfer paper P out from said pressing portion.

The transfer paper conveyer 14 is placed at the upper right side of the transfer belt 2 and is composed of a paper guiding plate 15 which form a passage from the transfer paper cassette 26 to the pressing portion of the transfer belt 2 under the pressing roller 12, a feeding roller 18, a paper feeding actuator 16 and a paper sensor 17 placed near the outlet 13 of the transfer paper cassette 26 and a resisting roller 19 and solenoid 20 for controlling the rotation of the resisting roller 19 on the paper guiding plate 15.

The paper delivery portion 21 is placed at the left side of the pressing portion of the transfer belt under the pressing roller 12 and consists of the paper guiding plate 22 forming a passage from the pressing portion to the tray 27 disposed near a port 24 for delivering a sheet of transfer paper, a paper sensor 23 and a delivery roller 25 at the end of the paper guiding plate 22.

Figure 3:
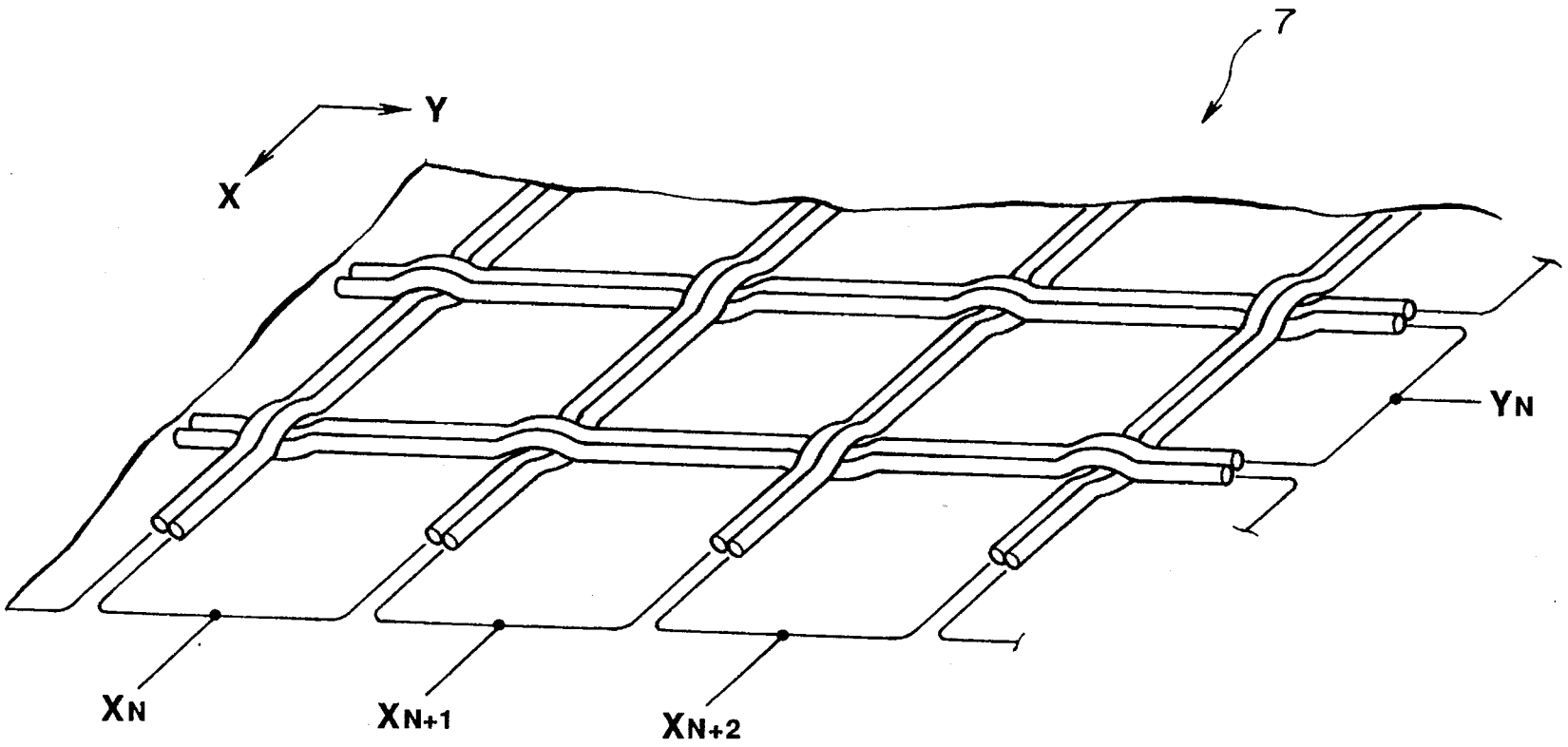
FIG. 3 is a perspective view showing the essential portion of the control grid of the image forming device shown in FIG. 2.
Figure 4:
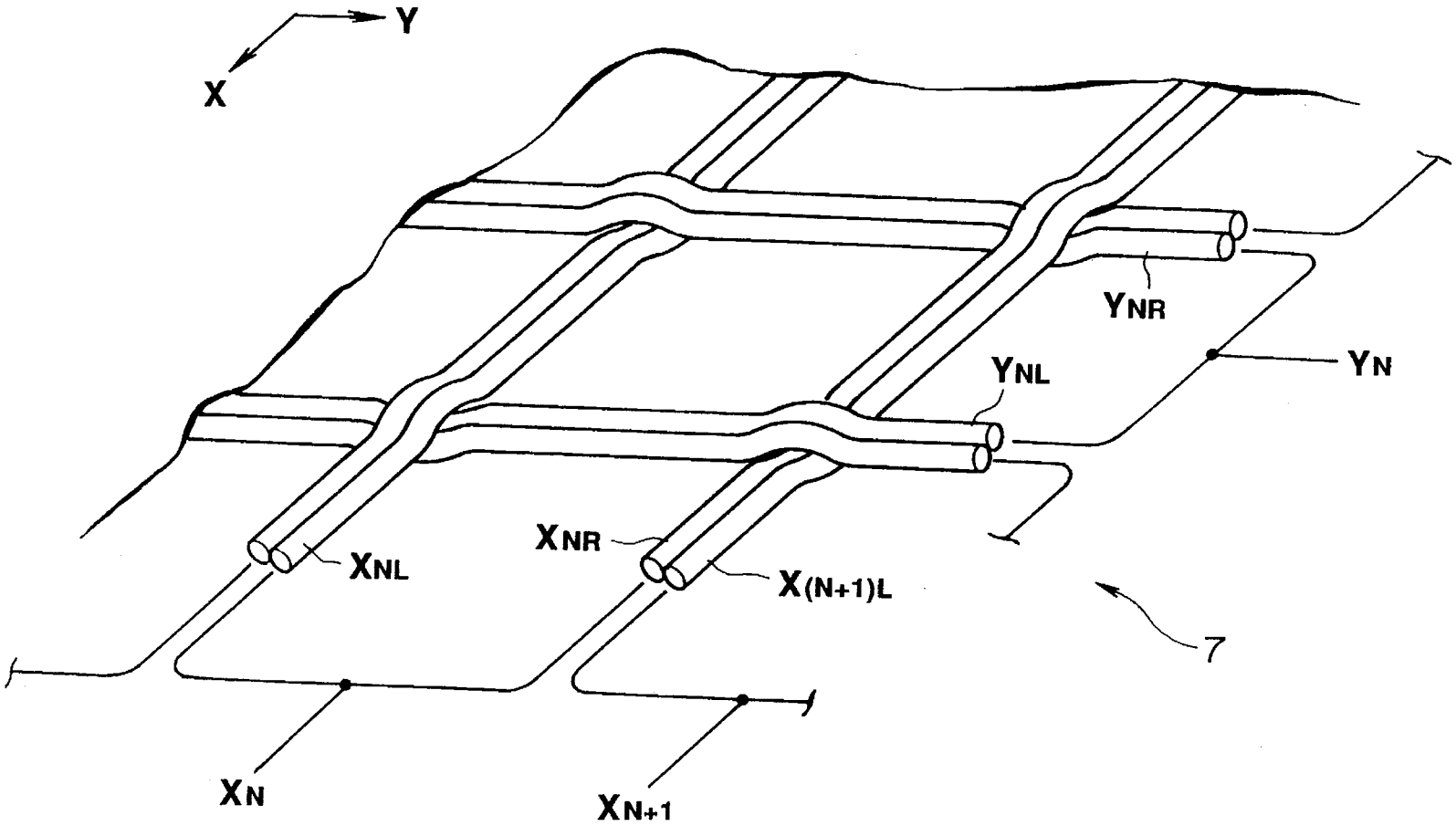
FIG. 4 is a perspective view showing the essential portion of the control grid shown in FIG. 2.

Referring now to FIGS. 2 to 5, construction of the control grid 7 and its control method will be described in detail as follows:

As shown in FIGS. 3 and 4, the control grid 7 consists of a group of horizontal electrodes ($X_1, \ldots, X_N, \ldots$) arranged parallel to each other in the direction X and a group of electrodes ($Y_1, \ldots, Y_N, \ldots$) perpendicular thereto and arranged parallel to each other in the direction Y. Any one of the unit control electrodes, e.g., electrode $X_N$ consists of a pair wire electrodes of 60 μm diameter. Conductors $X_{NL}$, $X_{NR}$ equally spaced from each other in the direction X. The paired conductors $X_{NL}$ and $X_{NR}$ are connected with each other at their ends and the same control voltage is commonly applied thereto and regulated. Unit control electrodes, e.g., $X_N$ and $X_N$+1, neighboring each other in the direction X or Y are formed by placing conductors $X_{NR}$ and $X_{(N+1)L}$ side by side.

The control grid has therein openings (XY . . . ), each of which is a space (e.g., opening $X_NY_N$ enclosed by conductors $X_{NL}$, $X_{NR}$ and $Y_{NL}$, $Y_{NR}$) wherein an amount of toner passing therethrough is controlled by the action of the unit control electrodes (e.g., $X_N$ and $Y_N$) when the control voltage is applied thereto.

In the present embodiment, the control grid 7 includes a required number of unit control electrodes in the direction X depending upon the width of the transfer belt 2 and four unit control electrodes in the direction Y. The voltage to be applied to the control electrode 7 is determined according to the result of an experiment conducted by applying +2000 v to backing electrode 8: toner T could not pass through the openings XY because of strong repulsion of the control grid 7 in both cases when a voltage of −300 v was applied to both groups of X and Y- electrodes and when voltage of −300 v was applied to one group of electrodes (e.g., X-electrodes) and a voltage of −100 v was applied to the other group of electrodes (e.g., Y-electrodes), but it could pass the openings XY overcoming the repulsion from the control grid 7 when a voltage of −100 v was applied to both groups of X and Y-electrodes.

Figure 5:
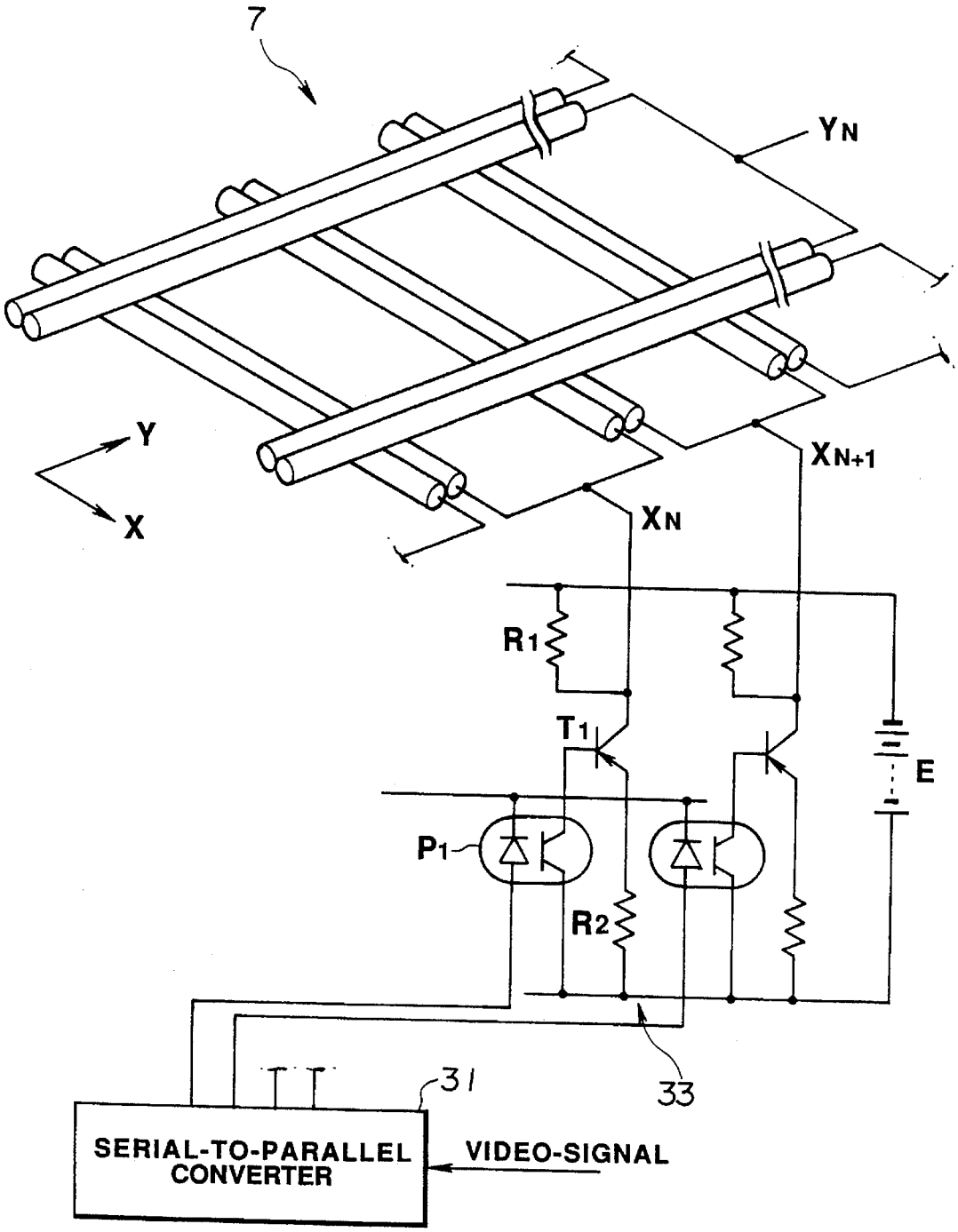
FIG. 5 is a control block diagram of the control grid shown in FIG. 2.

Based on the above-mentioned experimental results, a buffer/driver circuit 33 (FIG. 5) provided, respectively, for each of the control units of X-electrodes and Y-electrodes is designed to select a controlled voltage of −100 v at ON position and of −300 v at OFF position according to an electric signal to be described later. As shown in FIG. 5, this circuit is composed of a power source E, resistors R1 and R2, a transistor T1 and a photo-coupler P1.

The groups of X-electrodes of the control grid 7 through respective buffer/driver circuits 33 are connected to a serial parallel converter 31 shown in FIG. 1, while the groups of Y-electrodes through respective buffer/diver circuits 33 are connected to a ring counter 32.

Receiving electric video-signals (video-data) and synchronizing signals (clock signals) from a video-signal converter (not shown), the serial parallel converter 31 through the buffer/driver circuits 33 outputs a 4-bit video signal in parallel with a synchronizing signal for every 4 unit control groups of electrodes X (e.g.,, groups $X_1$, $X_2$, $X_3$ and $X_4$) so as to control them.

On the other hand, the ring counter 32 receives a synchronizing signal and puts out a control signal to sequentially scan each of the 4 unit control electrodes Y (e.g.,, $Y_1$, $Y_2$, $Y_3$ and $Y_4$) at a given cycle through the buffer/driver circuits 33 according to a synchronizing signal.

In other words, while the transfer belt 2 moves by 1 line, parallel output is given 4 times to each group of X-electrodes and sequential scanning of each unit of Y-control electrodes (e.g.,, $Y_1$, $Y_2$, $Y_3$ and $Y_4$) is conducted 4 times in total. Only when both electrodes being switched at ON, toner can pass through the openings XY overcoming the repelling force from the control grid to form a toner image on the transfer belt 2.

The control voltage applying means comprise of buffer/driver circuits 33, a serial parallel converter 31, a ring counter 32, a video-signal converter and so on.

The operation of the above-mentioned image forming device is as follows:

When a main motor (not shown) starts to rotate according to the print start signal from a host computer (not shown), a sheet of transfer paper P from a transfer paper cassette 26 is fed by the paper feeding roller 18 and pushes the actuator 16 by its front edge to operate the paper sensor 17 for sending a detecting signal to a central processing unit (CPU).

The transfer paper P is further sent to a resisting roller 19 and stops there because the roller 19 is stopped by the action of a resisting solenoid 20.

Figure 6:
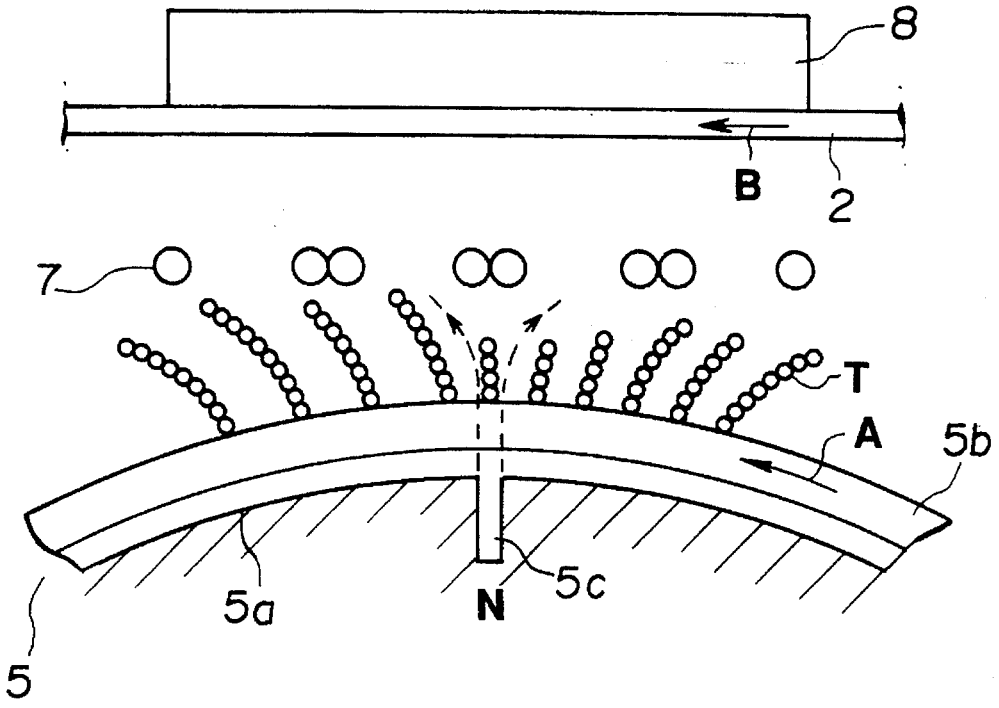
FIG. 6 is a view for explaining the peripheral construction of the control grid.

The CPU receives the paper detection signal and outputs an image-forming singal. At the same time, in the developing device 1, the toner transporting cylinder rotates in the direction A to carry on its surface **5*a* the toner T from the toner hopper 3*b* as shown in FIG. 6**.

The magnet of roller **5*a* has a groove 5*c* extending in the direction Y on its surface facing the backing electrode 8, and magnetic fields produced at both sides of the groove 5*c* causing them to repel each other and form a repelling magnetic field between the magnet roller 5*a* and the backing electrode 8, thereby, within this space area the toner particles are less restricted and easily go apart from the toner-cayrrying cylinder. The image-forming signal from the CPU effects to apply to the backing electrode 8 a voltage of an opposite polarity from that of the toner T. By the attracting force of the backing electrode 8 the toner particles T go from the cylinder's surface 5*b* to the backing electrode 8. While the toner is being transferred, the transfer belt 2** moves in the direction shown by arrow B.

When the voltage applied to the X-electrodes and the voltage applied to the Y-electrodes of the control grid 7 are changed respectively according to a signal from the serial parallel converter 31 and a signal from the ring counter 32, the repulsing force to the toner T in the openings XY is changed to selectively change the amount of toner T passing through the openings. Thereby the image, according to the image signal, is developed step by step with the toner T on the transfer belt 2.

On the other hand, when the CPU sends a signal to the resisting solenoid 20 in time so as to match the image on the transfer belt 2 and the transfer paper P at the pressing portion between the transfer belt 2 and the pressing roller 12 on the fixing holder 10, the resisting roller is released to rotate in order to send the transfer paper P to the pressing portion.

While the transfer belt 2, matched together at the toner image thereon with the transfer paper P, moves through the pressing portion between the fixing holder 10 and the pressing roller 12, the developed image on the transfer belt 2 is transferred onto the transfer paper P and fixed thereon at the same time. The pressing roller 12 and the fixing holder 10 with the heating element **10*a* disposed thereon transfer the melted toner T onto the transfer paper P, i.e., when the transfer paper P is pressed between the transfer belt 2 and the pressing roller 12 and is taken out therefrom, the toner melted by heating on the fixing holder 10 is almost transferred from the transfer belt 2 to the transfer paper P and fixed thereon because the transfer belt 2** has higher toner releasing power than that of the transfer paper P.

The transfer paper P whereon the developed toner image has been transferred and fixed pushes the actuator 23 for detecting the paper at the outlet of the pressing portion and is carried out from the device through the delivery port 24 by the rotation of the delivery roller 25. After a given time interval, the power supply to the heating element **10*a* of the fixing holder 10 and the stepping motor 13** is switched OFF to finish the above-mentioned operating cycle.

Referring now to FIGS. 1 and 7 to 16, on how to control the control grid 7 to form an image of letter <A> with toner on the transfer belt, will be explained as follows:

A capital letter <A> will be formed on the transfer belt 2 by changing the voltage applied to the unit control electrodes $X_1$, $X_2$, $X_3$, $X_4$, arranged in the direction X of the control grid 7 and the voltage applied to the unit control electrodes $Y_1$, $Y_2$, $Y_3$, $Y_4$, in the direction Y of the control grid 7. The transfer belt 2 moves at a given speed in the direction indicated with arrow C.

Figure 7A:
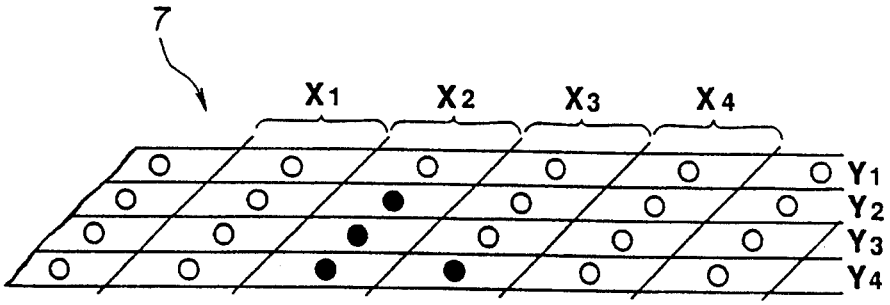
FIG. 7(*a*) shows openings of the control grid and FIG. 7(*b*) shows areas corresponding thereto on the transfer belt.
Figure 7B:
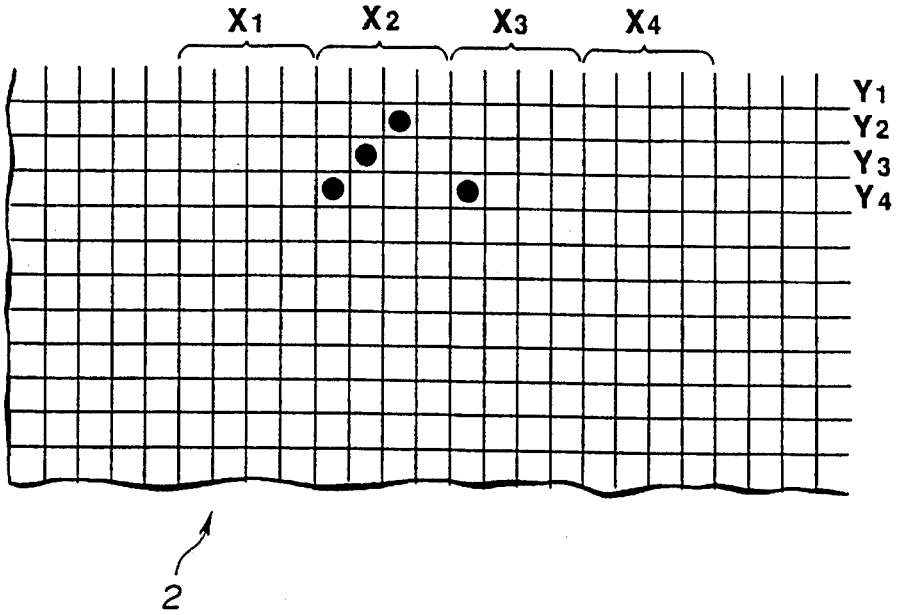

The state of space areas (openings) XY in the control grid 7 at the time T=1 until the transfer belt 2 moves by 1 line from a position at the moment of starting toner image forming and a toner image produced in said period on the transfer belt 2 are illustrated in FIGS. 7(*a*) and 7(*b*) respectively. When the unit control electrode $Y_1$ is switched ON and scanned, any one of the unit control electrodes $X_1$, $X_2$, $X_3$, $X_4$ cannot be switched ON and the space area XY does not allow toner to pass therethrough. When the unit control electrode $Y_2$ is then switched ON and scanned, the unit control electrode $X_2$ is switched ON to allow toner to pass through the space area $X_2$, $Y_2$. When the unit control electrode $Y_3$ is then switched ON and scanned, the unit control electrode $X_2$ is switched ON to allow toner to pass through the space area $X_2$, $Y_3$. When the unit control electrode $Y_4$ is then switched ON and scanned, the unit control electrodes $X_2$ and $X_3$ are switched ON to allow toner to pass through the space areas $X_2$, $Y_4$ and $X_3$, $Y_4$. Consequently, as shown in FIG. 7(*b*), dots indicated in black color are formed on the transfer belt at the positions corresponding to the above-mentioned space areas XY of the control grid.

Figure 8A:
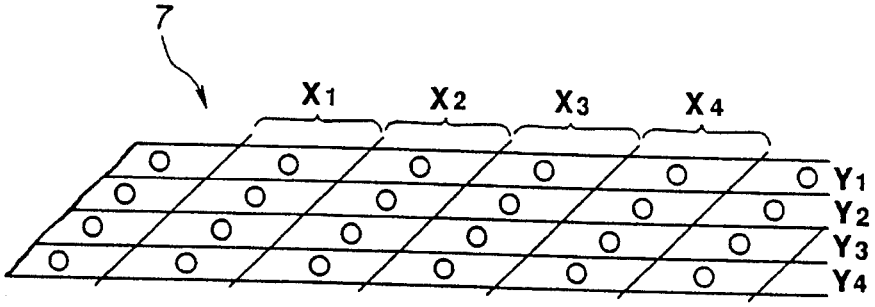
FIG. 8(*a*) shows openings of the control grid and FIG. 8(*b*) shows areas corresponding thereto on the transfer belt.
Figure 8B:
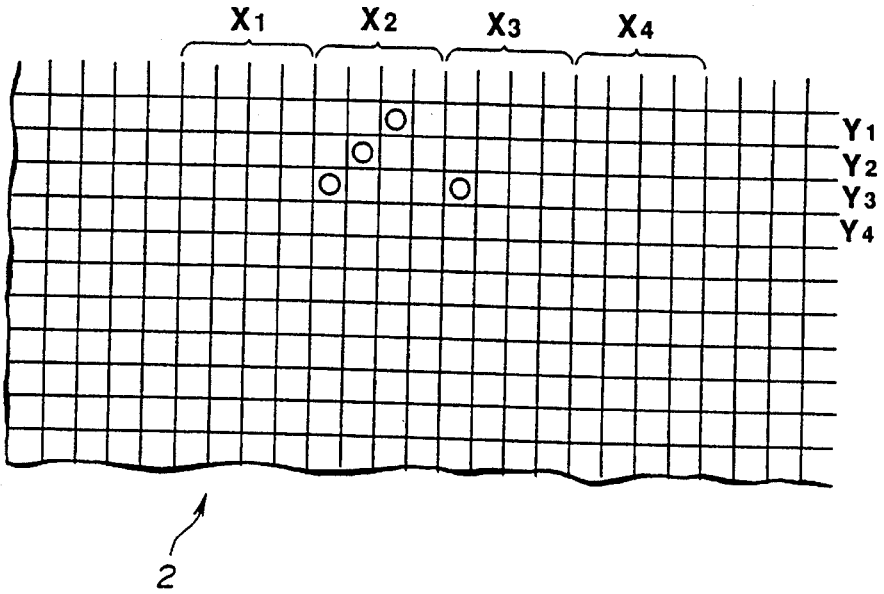

Since the transfer belt 2 has moved by 1 line at the time T=2, the transfer belt 2 has shifted by 1 line areas corresponding to the unit control electrodes $Y_1$, $Y_2$, $Y_3$, $Y_4$ of the control grid 7 as shown in FIG. 8(*b*). At the time T=2, when the unit control electrodes $Y_1$, $Y_2$, $Y_3$, $Y_4$ in the direction Y of the control grid 7 are turned ON and scanned, the unit control electrodes $X_1$, $X_2$, $X_3$, $X_4$ in the direction X cannot be switched ON, thereby, as shown in FIG. 8(*a*), there is no space area XY allowing toner to pass therethrough.

Figure 9A:
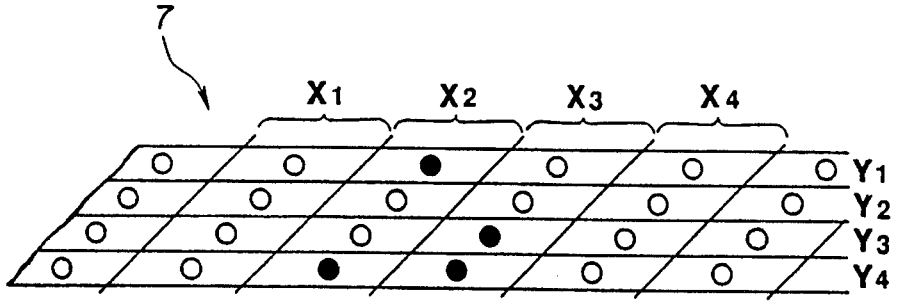
FIG. 9(*a*) shows openings of the control grid and FIG. 9(*b*) shows areas corresponding thereto on the transfer belt.
Figure 9B:
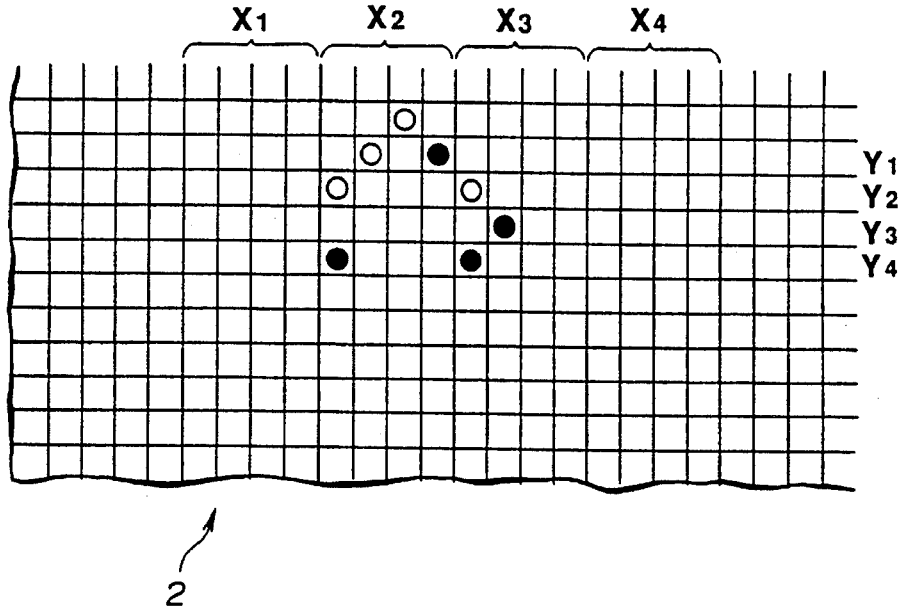

At the time T=3, as shown in FIGS. 9(*a*),9(*b*), the space areas $X_2Y_1$, $X_3Y_3$, $X_2Y_4$, $X_3Y_4$ are controlled so as to allow toner T to pass therethrough and dots indicated in black color (FIG. 9(*b*)) are formed on the transfer belt 2.

Figure 10A:
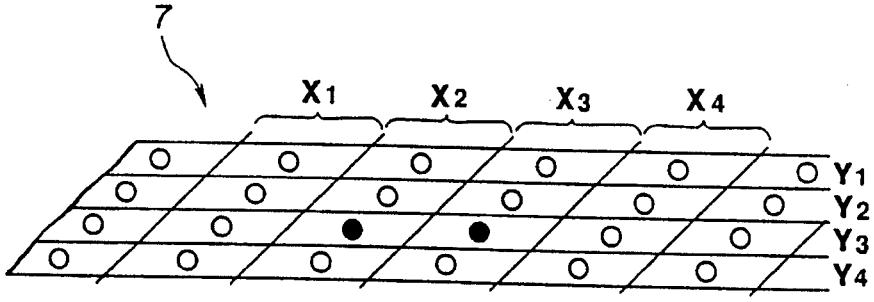
FIG. 10(*a*) shows openings of the control grid and FIG. 10(*b*) shows areas corresponding thereto on the transfer belt.
Figure 10B:
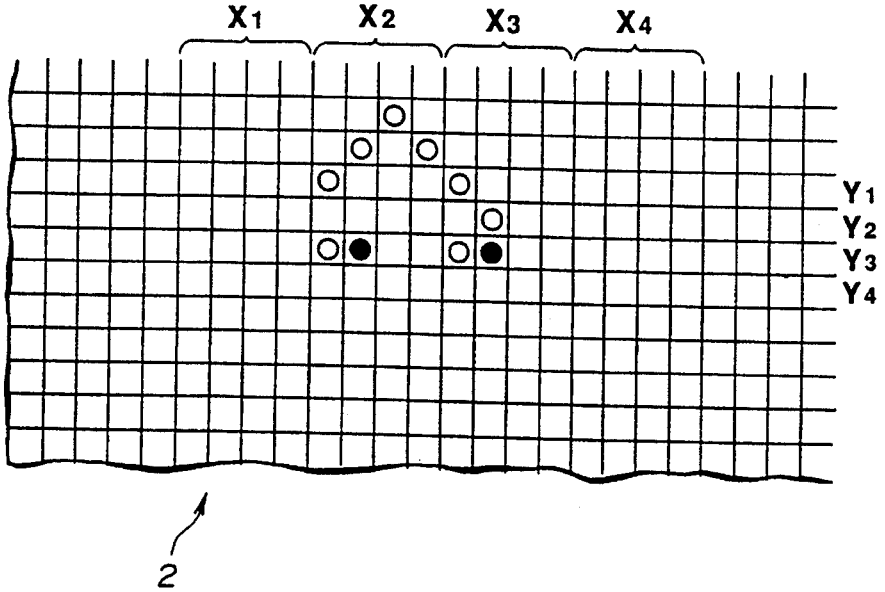

At the time T=4, as shown in FIGS. 10(*a*),10(*b*), the space areas $X_2Y_3$, $X_3Y_3$ are controlled so as to allow toner T to pass therethrough and dots indicated in black color (FIG. 10(*b*)) are formed on the transfer belt 2.

Figure 11A:
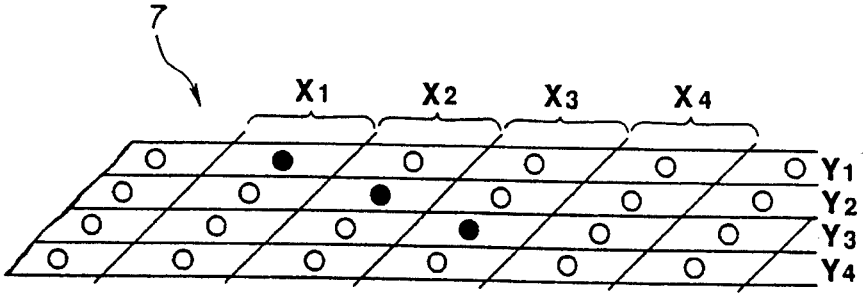
FIG. 11(*a*) shows openings of the control grid and FIG. 11(*b*) shows areas corresponding thereto on the transfer belt.
Figure 11A:
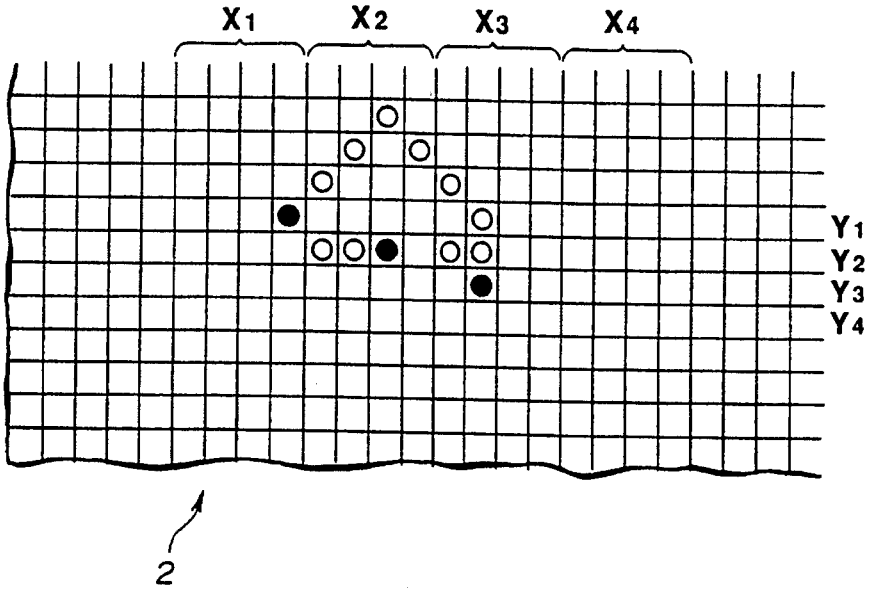

At the time T=5, as shown in FIGS. 11(*a*),11(*b*), the space areas $X_1Y_1$, $X_2Y_2$, $X_3Y_3$ are controlled so as to allow toner T to pass therethrough and thereby to form dots indicated in black color (FIG. 9(*b*)) on the transfer belt 2.

Figure 12A:
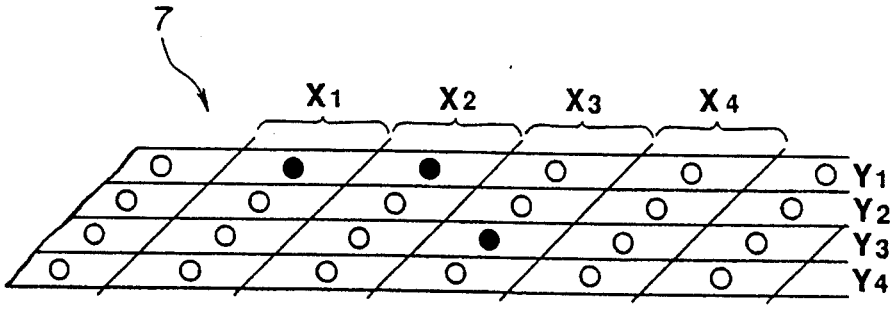
FIG. 12(*a*) shows openings of the control grid and FIG. 12(*b*) shows areas corresponding thereto on the transfer belt.
Figure 12B:
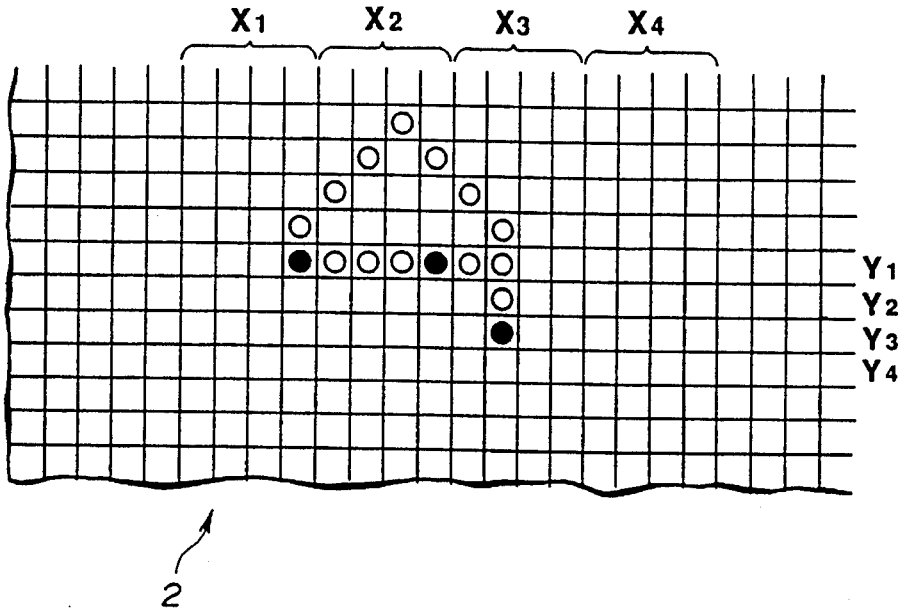

At the time T=6, as shown in FIGS. 12(*a*),12(*b*), the space areas $X_1Y_1$, $X_2Y_1$, $X_3Y_3$ are controlled so as to allow toner T to pass therethrough and dots indicated in black color (FIG. 12(*b*)) are formed on the transfer belt 2.

Figure 13A:
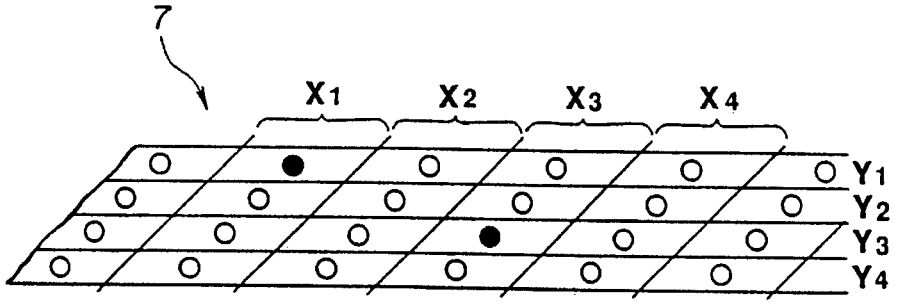
FIG. 13(*a*) shows openings of the control grid and FIG. 13(*b*) shows areas corresponding thereto on the transfer belt.
Figure 13A:
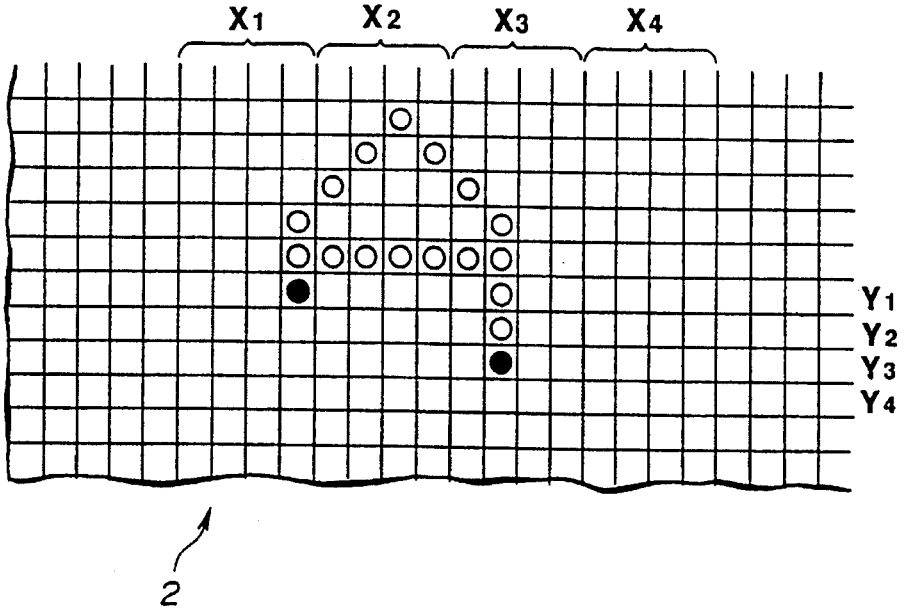

At the time T=7, as shown in FIGS. 13(*a*),13(*b*), the space areas $X_1Y_1$, $X_3Y_3$ are controlled so as to allow toner T to pass therethrough and dots indicated in black color (FIG. 13(*b*)) on the transfer belt 2.

Figure 14A:
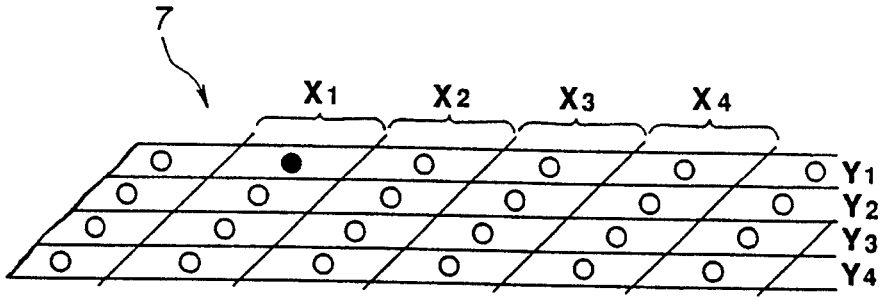
FIG. 14(*a*) shows openings of the control grid and FIG. 14(*b*) shows areas corresponding thereto on the transfer belt.
Figure 14B:
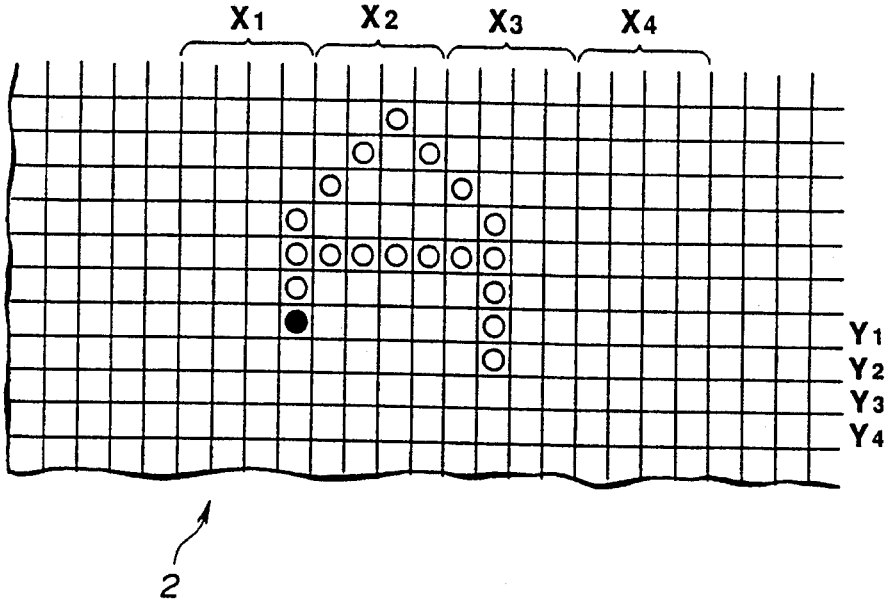
Figure 15A:
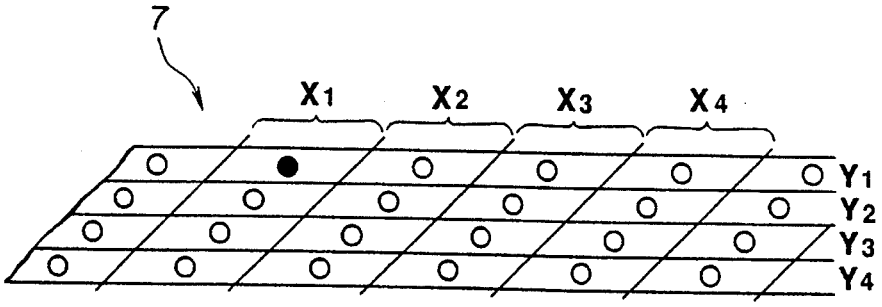
FIG. 15(*a*) shows openings of the control grid and FIG. 15(*b*) shows areas corresponding thereto on the transfer belt.
Figure 15B:
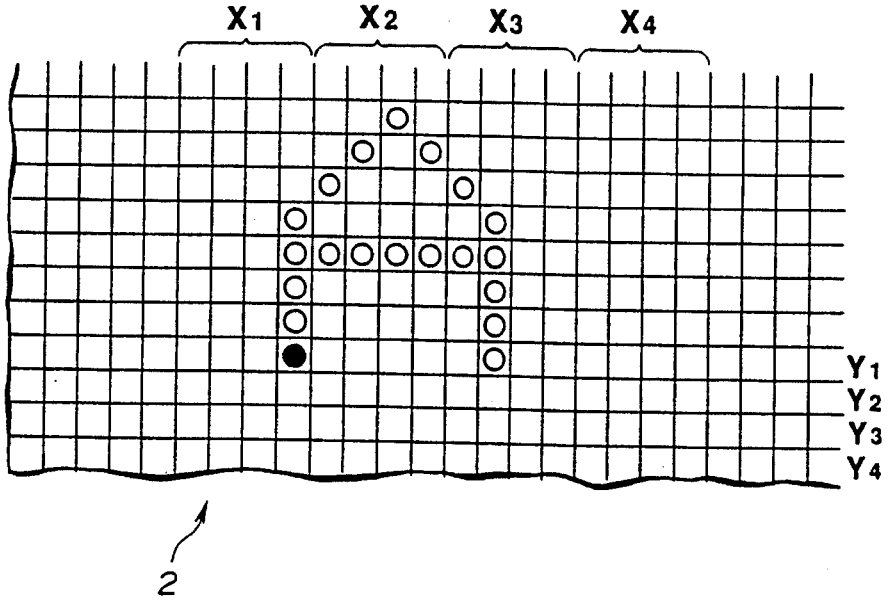

At the time T=8 and 9, as shown in FIGS. 14(*a*),14(*b*) and 15(*a*),15(*b*) the space area $X_1Y_1$ is controlled so as to allow toner T to pass therethrough and dots indicated in black color (FIGS. 14(*b*) and 15(*b*)) are formed on the transfer belt 2.

Figure 16A:
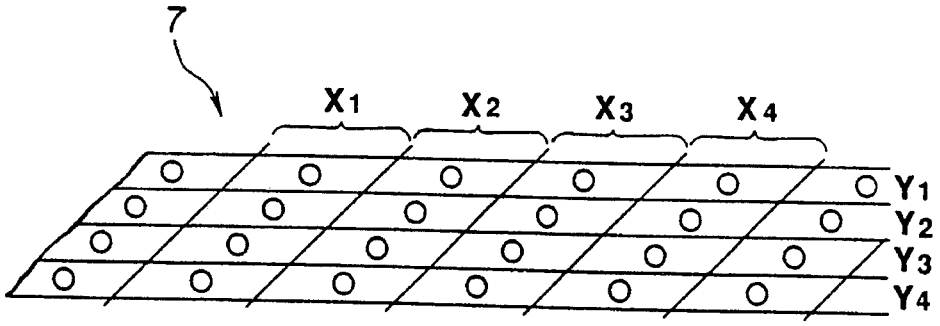
FIG. 16(*a*) shows openings of the control grid and FIG. 16(*b*) shows corresponding thereto areas on the transfer belt.
Figure 16B:
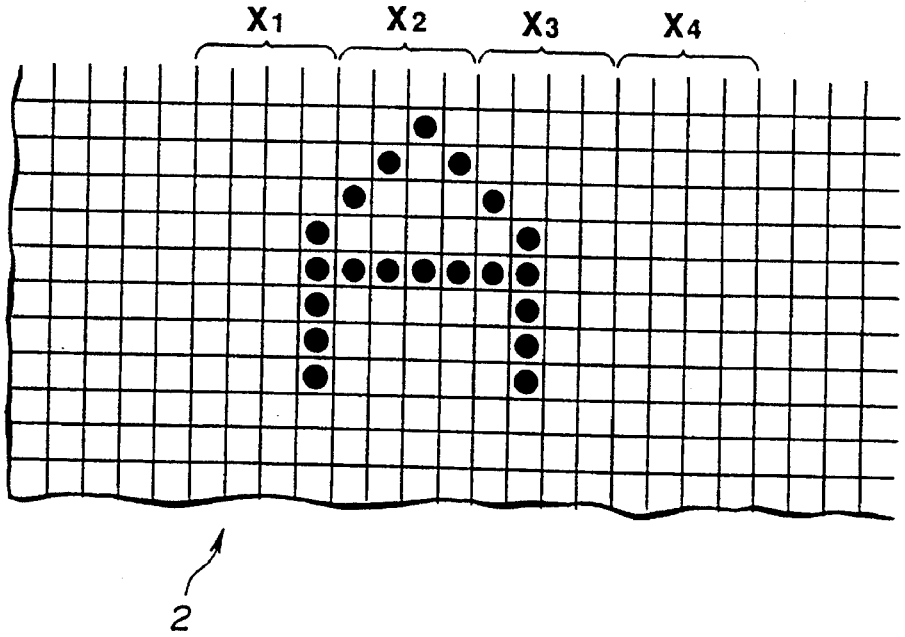

As shown in FIGS. 16(*a*) and 16(*b*), the letter <A> is now formed with toner on the transfer belt 2 and then all space areas of the control grid 7 are controlled not to allow toner to pass therethrough.

As is apparent from the foregoing description, in the image forming device of the present invention a control grid 7 composed of horizontal electrodes and electrodes perpendicular thereto arranged respectively in direction X and Y are disposed between the transfer belt 2 and the developing unit 1 provided with the toner carrier 5 and the backing electrode 8 are also placed on the transfer belt's surface opposite the belt's surface facing the control grid 7. Furthermore, the control grid 7 is provided with the buffer/driver circuit 33, serial parallel converter 31 and ring counter 32 which composes the means to apply control voltage for adjusting the amount of toner passing through the openings of the control grid 7. While the toner T having negative polarity move to the backing electrode 8 whereto a voltage having the opposite polarity is applied, the control grid is operated so as to adjust the amount of toner T passing through the space areas thereof. Thus a regulated amount of toner T is transferred to the transfer belt 2 close to the backing electrode 8 and forms a toner image thereon. The adjustment of a repulsing force of the control grid 7 against the toner T is conducted by changing the same polarity voltage applied across the control electrodes X and Y through the operation of a means for applying a controlled amount of voltage according to a video-signal from the CPU.

Since the control grid 7 of the present device always has a repulsing force against the toner T, it can be free from adhesion of the toner particles without applying AC voltage as conducted in the conventional device. According to the present invention it is also possible to eliminate the deterioration of the printing quality due to the clogging of openings with toner particles and/or the necessity for frequent maintenance of the control grid 7 with cleaning and/or replacing the parts. This relieves the use's maintenance costs.

Since in the device, according to the present invention, the toner image is directly formed by controlling the space areas (grid openings) XY in the control grid 7 by changing the voltage applied to the control grid without forming a latent image on photo-sensitive material, it is possible to eliminate the necessity for using such an image carrier as photo-sensitive material and also for providing a means for writing the latent image onto the image carrier and erasing it therefrom, thereby the size of the device can be reduced. Furthermore, the absence of photo-sensitive material can solve all the problems faced in the conventional devices using photo-sensitive material, for example, selenium which is easily damaged by both mechanical and thermal means and can generate ozone at the corona's discharging and cause environmental pollution by harmful substances included therein.

The diagonal arrangement of X-electrodes of the space-charing openings XY of the control grid 7 against the surface of the transfer belt 2 makes it possible to put a desired print any place on the belt's surface without interferers X-electrodes. Furthermore, by using the control grid which also includes a plurality of X-electrodes diagonally arranged in the direction Y it is possible to attain a high resolution of printing image up to 200 DPI at a relatively wide spacing of Y-electrodes. Strictly speaking, since the transfer belt 2 moves at a constant speed during printing, there may be a small deflection of printing positioning but it cannot effect the level of printing quality.

The control grid 7 has a lattice-like form and is flexible enough to be easily and accurately mounted in a stretched state.

In the described embodiment of the present invention, a toner image is formed on the transfer belt 2 and then transferred therefrom to a sheet of transfer paper P in such a way that the transfer paper is accurately positioned on the toner image of the transfer belt and heated in a pressed state to melt and fix the toner on the transfer paper P. Consequently, the device proposed by the present invention is free from the problem that is inherent in the conventional device where the printing quality is effected by the characteristics (e.g., thickness, resistance) of the recording element and said elements having an unfixed toner image thereon requires special complicated supporting means. It can print at a stable quality level on any kind of recording element.

The present embodiment uses the transfer belt 2 made of a polyimide resin base of 20 μm in thickness, which allows the easy and reliable forming of a toner image thereon and also the immediate heating of the toner image without warming up because of the small heat capacity required for fixing the toner image thereon.

While in the present embodiment the toner transporting cylinder 5*a* is grounded to let the toner T have a negative polarity, it does not mean that the toner must have negative polarity. Instead, it is also possible to use a positively polarized toner on the condition that the backing electrode is negatively polarized and the control grid is operated by applying voltage having a positive polarity.

While in the present embodiment the same voltage is applied to the electrodes in directions X and Y when the control grid being held "ON" so as to form a dot in form of a complete circle but it is also possible to form a dot elongated in direction X or Y by applying different voltages to the electrodes in directions X and Y respectively.

As stated above, the image forming device according to the present invention comprises a toner carrier for polarizing the toner and holding it thereon; a backing electrode whereto voltage having a polarity opposite to that of the toner is applied so as to attract the toner thereto; a recording element placed between the toner carrier and the backing electrode; a control grid which consists of a number of electrodes arranged crosswise in directions X and Y to form space openings therein and which is placed between the recording element and the toner carrier; and a control voltage applying means which applies a voltage of the same polarity as that of the toner to each of the electrodes in directions X and Y and also which controls said applied voltage in such a way that the toner repulsing force produced in space-charged openings of the control grid is selectively changed to be larger or smaller than the toner attracting force of the backing electrode.

Accordingly, the present device allows the toner to form an image on the recording element, always making the control grid have a repulsing force to the toner. It means that the possibility for clogging the space openings of the control grid with toner particles is eliminated and the necessity for frequent cleaning of the control grid and/or for replacing parts, thereby relieving the user from much maintenance work.

I claim:

1. An image-forming device comprising:

a toner carrier for polarizing and carrying toner;

a backing electrode placed facing the toner carrier and supplied with voltage of an opposite polarity to the toner carrier;

a control grid placed between toner on the toner carrier and the backing electrode and for controlling the movement of the toner from the toner carrier towards the backing electrode;

a recording element movable between the control grid and the backing electrode; and a control voltage applying means for adjusting voltage applied to the control grid;

said control grid comprises wire electrodes extending in the direction (X) to carry the recording element and wire electrodes extending in the direction (Y) intersecting the direction (X), said control grid having grid openings defined by said wire electrodes;

said control voltage applying means applying voltage having the same polarity as that of the toner to each of the wire electrodes in both directions (X and Y) in such a way that a continuously applied toner-repulsing force produced by an electrical field within each of the grid openings is selectively changed to a larger or smaller one than the other attracting force produced by the backing electrode, further in which the recording element is a single transfer belt, said single transfer belt cooperating with said toner and control grid to preliminarily receive a toner image, and cooperating with a fixing holder to transfer and fix said toner image onto a sheet of paper.

2. The device of claim 1, wherein said belt directly contacts said backing electrode.

3. The device of claim 1, wherein a constant clearance is maintained between said belt and said control grid.

4. An image-forming device for forming a toner image on a recording medium, comprising:

a toner carrier;

a backing electrode placed facing the toner carrier with a specified distance therebetween and provided with a voltage of an opposite polarity to the toner carrier;

a control grid placed between said toner carrier and said backing electrode;

wherein the backing electrode has a surface facing the control grid; and wherein an endless-type transfer belt is provided in between said backing electrode and said control grid with a rear surface of said belt contacting at least said surface of the backing electrode, said belt also contacting a sheet of recording material.

5. The device of claim 4, in which the endless-type transfer belt is stretch-mounted on a driving roller and a tension roller in such a way that the belt can linearly move, keeping contact with said surface of the backing electrode.

6. The device of claim 4 further comprising:

a fixing holder with a heating source disposed facing the backing electrode and a pressure roller urged to the fixing holder with the transfer belt located between said fixing holder and said pressure roller;

and wherein a sheet of recording material is located between the pressure roller and transfer belt to transfer a toner image onto the sheet and fix it thereon by heat.

7. The device of claim 4, in which the endless-type transfer belt comprises a film comprising heat-resistant polyimide resin.

8. The device of claim 4, in which a constant clearance is maintained between said belt and said control grid.

* * * * *